United States Patent [19]

Clearman et al.

[11] Patent Number: 4,881,556

[45] Date of Patent: Nov. 21, 1989

[54] LOW CO SMOKING ARTICLE

[75] Inventors: Jack F. Clearman, Blakely, Ga.; Olivia P. Furin; Joseph J. Chiou, both of Clemmons, N.C.; William C. Squires, Winston-Salem, N.C.

[73] Assignee: R. J. Reynolds Tobacco Company, Winston-Salem, N.C.

[21] Appl. No.: 203,392

[22] Filed: Jun. 6, 1988

[51] Int. Cl.[4] ..... A24D 1/00

[52] U.S. Cl. ..... 131/359; 131/194

[58] Field of Search ..... 131/359, 369, 194, 195

[56] References Cited

U.S. PATENT DOCUMENTS

| | | |
|---|---|---|
| 29,436 | 7/1860 | Lindlsey . |
| 235,886 | 12/1880 | Lindsley . |
| 261,056 | 7/1882 | Smith . |
| 1,529,181 | 7/1922 | Holmes . |
| 2,098,619 | 11/1937 | Finnell . |
| 2,907,686 | 10/1959 | Siegel . |
| 3,200,819 | 4/1963 | Gilbert . |
| 3,223,090 | 12/1965 | Strubel . |
| 3,258,015 | 6/1966 | Ellis . |
| 3,356,094 | 12/1967 | Ellis . |
| 3,516,417 | 6/1970 | Moses . |
| 3,738,374 | 6/1973 | Bennett . |
| 3,773,053 | 11/1973 | Stephens, Jr. . |
| 3,863,644 | 2/1975 | Hunt . |
| 4,044,777 | 8/1977 | Boyd . |
| 4,079,742 | 3/1978 | Ranier . |
| 4,284,089 | 8/1981 | Ray . |
| 4,286,604 | 9/1981 | Ehretsmann . |
| 4,326,544 | 4/1982 | Hardwick . |
| 4,340,072 | 7/1982 | Bolt . |
| 4,391,285 | 7/1983 | Burnett . |
| 4,407,308 | 10/1983 | Baker . |
| 4,437,855 | 9/1984 | Lanzillotti . |
| 4,474,191 | 10/1984 | Steiner . |
| 4,481,958 | 11/1984 | Ranier . |
| 4,553,556 | 11/1985 | Lephardt . |
| 4,596,258 | 6/1986 | Steiner . |
| 4,943,941 | 3/1976 | Boyd . |

FOREIGN PATENT DOCUMENTS

| | | |
|---|---|---|
| 276250 | 3/1933 | Australia . |
| 117355 | 12/1983 | European Pat. Off. . |
| 174645 | 9/1985 | . |
| 370692 | 11/1906 | France . |
| 998556 | 11/1945 | France . |
| 1264962 | 8/1960 | France . |
| 2057421 | 8/1969 | France . |
| 2057422 | 8/1969 | France . |
| 2003749 | 11/1970 | France . |
| 23237 | 7/1986 | Iran . |
| 13985/3890 | 9/1985 | Liberia . |
| 275420 | 9/1949 | Switzerland . |
| 1185887 | 6/1967 | United Kingdom . |
| 1431045 | 7/1973 | United Kingdom . |

OTHER PUBLICATIONS

Ames et al., Mut. Res., 31: 347–364 (1975).
Nago et al., Mut. Res., 42: 355 (1977).
Langes Handbook of Chemistry, 10, 272–274 (11th ed., 1973).
Hackhs Chemical Dictionary, 34 (4th ed., 1969).
Certain materials submitted to the Senate Committee on Commercey, by Mr. Herbert A. Gilbert in Sep. of 1967. A copy of the newspapers which was reproduced in the (AAV) materials.
Guiness Book of World Records, pp. 242–243 (1985 edition).
Guiness Book of World Records, p. 194 (1986 edition).

*Primary Examiner*—V. Millin
*Attorney, Agent, or Firm*—Grover M. Myers; David G. Conlin

[57] ABSTRACT

The present invention is directed to cigarettes and other smoking articles, as well as disposable cartridges for such smoking articles, which utilize compact carbonaceous fuel elements, and which provide low levels, i.e., less than about 10 mg, of carbon monoxide (CO) to the smoker. In general, these high density (about 0.7 to 1.5 g/cc) fuel elements have a plurality of passageways therein or thereon, and further comprise at least about 80–90% carbon by weight. The fuel elements are less than about 7 mm in length, preferably from about 3 to 6.5 mm, most preferably from about 5.5 to 6.0 mm, and less than about 7 mm in diameter, preferably from about 4.0 to 6.5 mm, and most preferably from about 4.8 to 6.0 mm.

17 Claims, 1 Drawing Sheet

LOW CO SMOKING ARTICLE

BACKGROUND OF THE INVENTION

The present invention is directed to cigarettes and other aerosol generating smoking articles which provide less than about 10 mg of carbon monoxide (CO) to the smoker, and to compact fuel elements useful in these articles. Cigarettes, cigars and pipes containing various forms of tobacco are the most popular forms of smoking products. Thus, as used herein, the term "smoking article" includes cigarettes, cigars, pipes, and other smoking products which generate an aerosol such as smoke.

Many smoking products and aerosol generating smoking articles have been proposed through the years as improvements upon, or as alternatives to, the popular forms of smoking products, especially cigarettes.

Some, for example, have proposed tobacco substitute smoking materials. See, for example, U.S. Pat. No. 4,079,742 to Rainer et al. Two such materials, Cytrel and NSM (New Smoking Material), were introduced in Europe in the 1970's as partial tobacco replacements, but did not realize any long-term commercial success.

Others have proposed smoking articles, especially cigarette smoking articles, based upon the generation of an aerosol or a vapor. See, for example, the background art cited in U.S. Pat. No. 4,714,082 to Banerjee et al.

As far as the present inventors are aware, none of the foregoing smoking articles has ever realized any commercial success, and none have ever been widely marketed. The absence of such smoking articles from the marketplace is believed to be due to a variety of reasons, including insufficient aerosol generation, both initially and over the life of the product, poor taste, off-taste due to thermal degradation of the aerosol forming and/or flavor generating materials, the presence of substantial pyrolysis products and sidestream smoke, and unusual or unsightly appearance of the articles themselves.

Thus, despite decades of interest and efforts, there is still no aerosol generating smoking article on the market which provides the benefits and advantages associated with cigarette smoking, without delivering considerable quantities of incomplete combustion and pyrolysis products.

More recently however, in Banerjee et al., supra. and in European Pat. Publication Nos. 0174645 and 0212234 to the R.J. Reynolds Tobacco Co., cigarettes and other aerosol generating smoking articles are described which are capable of providing the benefits and advantages associated with cigarette smoking, without delivering appreciable quantities of incomplete combustion and pyrolysis products and without many of the other drawbacks associated with previous aerosol generating smoking articles. The preferred cigarettes and other smoking articles of these publications are described as having small, preferably carbonaceous fuel elements, and a physically separate aerosol generating means. No indication is made regarding the amount of carbon monoxide delivered by those smoking articles.

SUMMARY OF THE INVENTION

The present invention is directed to cigarettes and other smoking articles, as well as disposable cartridges for use in such smoking articles, each of which utilize a compact carbonaceous fuel elements, and which provide low levels, i.e., less than about 10 mg, of carbon monoxide (CO) to the smoker.

In general, the fuel elements employed herein comprise carbon and a binder, and are less than about 7 mm in length, preferably from about 3 to 6.5 mm, most preferably from about 5.5 to 6.0 mm, and less than about 7 mm in diameter, preferably from about 4.0 to 6.5 mm, and most preferably from about 4.8 to 6.0 mm.

Advantageously, the compact carbonaceous fuel elements used herein may be "baked-out" after formation, by heating the same in a non-oxidizing atmosphere, e.g., nitrogen, at a temperature of about 800°–950° C. for at least about two hours. This procedure converts the binder to carbon, thereby further reducing the carbon monoxide produced on burning the fuel element.

The compact fuel elements are provided with at least one longitudinal passageway, which may be located either at or near the central axis of the element, or situated at or near the peripheral edge of the element. Preferably a combination of central and peripheral passageways is employed. The presence of such passageways aids in the lightability of the fuel elements and assists in maintaining burning during smolder periods.

The compact carbonaceous fuel elements used in the present invention are particularly advantageous because they light easily and burn cleanly. When cigarettes and/or other smoking articles are prepared using the fuel elements described herein, they afford from eight to ten puffs under FTC smoking conditions (defined as a 35 ml puff volume of 2 seconds duration, followed by 58 seconds of smolder). The amount of carbon monoxide provided to the smoker of the present cigarettes over these eight FTC puffs is generally less than about 10 mg, preferably less than about 8 mg, and most preferably less than about 6 mg, as measured by non-dispersive infra-red analysis.

In preferred embodiments of the present invention, the aerosol delivered to the user has no significant mutagenic activity as measured by the Ames test. See Ames et al., *Mut. Res.*, 31:347–364 (1975); Nagao et al., *Mut. Res.*, 42:335 (1977).

In addition, the cigarettes and other smoking articles of the present invention are preferably capable of delivering 3 mg or more of aerosol in the first 3 puffs when smoked under FTC smoking conditions. Moreover, preferred embodiments of the invention deliver an average of at least about 0.8 mg of wet total particulate matter per puff for at least about 6 puffs, preferably for at least about 8 puffs, under FTC smoking conditions.

As used herein, and only for the purposes of this application, "aerosol" is defined to include vapors, gases, particles, and the like, both visible and invisible, and especially those components perceived by the user to be "smoke-like," generated by action of the heat from the burning fuel element upon substances contained within the aerosol generating means, or elsewhere in the article. As so defined, the term "aerosol" also includes volatile flavoring agents and other desirable volatile substances.

The cigarettes of the present invention and fuel elements useful therein, are described in greater detail in the accompanying drawings and in the detailed description of the invention which follows.

DETAILED DESCRIPTION OF A PREFERRED EMBODIMENT

Figure 1:
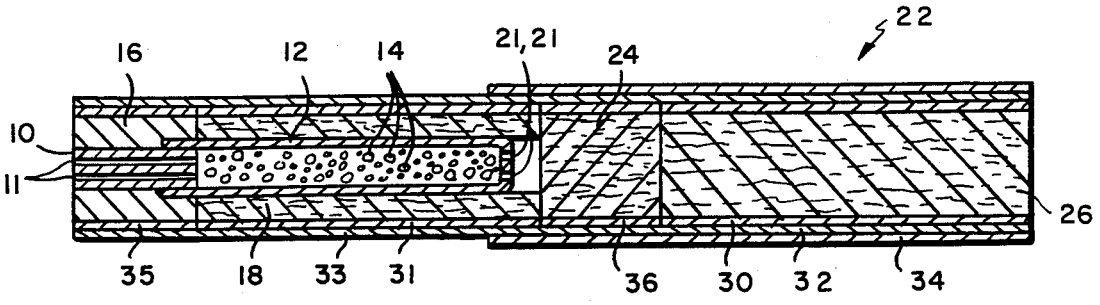
FIG. 1 is a longitudinal view of one preferred cigarette of the present invention, which utilizes a compact carbonaceous fuel element.

FIG. 1 illustrates one preferred cigarette of the present invention which utilizes a compact carbonaceous fuel element.

The compact fuel element 10 is provided with a plurality of longitudinal passageways 11, all of which in this embodiment pass through the central core of the fuel element. As will be evident from the details which follow, other passageway configurations, such as peripheral passageways, and/or combinations of passageway types may be employed herein with equal success.

Overlapping about 1.5 mm of the mouth end of the fuel element 10 is a metallic capsule 12, which contains a particulate substrate material 14 including one or more aerosol forming substances (e.g., polyhydric alcohols such as glycerin or propylene glycol).

The periphery of fuel element 10 is surrounded by a resilient jacket of insulating fibers 16, such as glass fibers, and capsule 12 is surrounded by a roll of tobacco 18. Two passageways 20 and 21 are provided at the mouth end of the capsule in the center of the sealed end of the tube.

At the mouth end of tobacco roll 18 is situated a mouth end piece 22 comprising (1) a segment of tobacco paper 24 followed by, (2) a nonwoven mat of polypropylene scrim 26, both of which act to cool the aerosol delivered to the user. The article, or portions thereof, is overwrapped with one or more layers of cigarette paper 30–36.

As illustrated in FIG. 1, the combination of the fuel element 10 and the metallic capsule 12, forms a disposable aerosol generating cartridge which can be used in a reusable or disposable holder, such as a cigarette holder, or a modified pipe bowl.

As stated above, the fuel elements of the present invention may have passageways in any (or all) of several different locations. For example, passageways, such as channels or slots, may be provided on the peripheral surface of the fuel elements. On the other hand, passageways may be located within the body of the fuel element, either near the periphery, or centered at the axis. In some cases, a mixture of these passageway types may be desirable. Such passageways assist in the lightabilty of the fuel element and assist in heat transfer to the aerosol generating means.

FIGS. 2–6 illustrates several preferred fuel element passageway configurations useful in the smoking article of FIG. 1.

Upon lighting, the compact fuel element of the present invention quickly begins to burn over its entire exposed surface, generating the heat used to volatilize the aerosol forming material or materials present in the aerosol generating means. These volatile materials are then drawn toward the mouth end, especially during puffing, and into the user's mouth, akin to the smoke of other cigarettes.

In general, the compact carbonaceous fuel elements employed in the present invention have a diameter of less than about 7 mm, preferably from about 4.0 to 6.5 mm, and most preferably from about 4.8 to 6.0 mm. The length of the compact fuel elements is similar, i.e., less than about 7 mm, preferably from about 3 to 6.5 mm, most preferably from about 5.5 to 6.0 mm. The density of these compact fuel elements will generally range from about 0.7 g/cc to about 1.5 g/cc. Preferably the density is greater than about 0.85 g/cc.

The principal material used for the formation of the compact carbonaceous fuel elements employed in the present invention is carbon. Preferably, the carbon content of these fuel elements is at least 60 to 70%, most preferably about 80 to 90% or more, by weight. High carbon content fuel elements are preferred because they produce minimal pyrolysis and incomplete combustion products, little or no visible sidestream smoke, and minimal ash, and have high heat capacity. However, lower carbon content fuel elements e.g., about 50 to 60% by weight may be used, especially where a minor amount of tobacco, tobacco extract, or a nonburning inert filler is used. Preferred fuel element compositions are described in greater detail in the Examples provided infra.

Generally, the fuel elements are prepared by admixing powdered carbon, a binder such as sodium carboxymethylcellulose, selected burn additives, such as potassium carbonate, and water, to form a moldable or extrudable paste. Using conventional molding or extrusion techniques, the paste is formed into fuel element rods having the desired diameter, the rods are then dried and cut to the desired length. If desired, the binder may be "baked-out" of the fuel element by heating the same in a non-oxidizing atmosphere, e.g., nitrogen, at a temperature of about 800°–950° C. for about two hours. This process converts the binder to carbon, affording an essentially carbon-only fuel element.

The aerosol generating means used in practicing the invention is physically separate from the fuel element. By physically separate it is meant that the substrate, container, or chamber which retains the aerosol forming materials is not mixed with, or a part of, the burning fuel element. This arrangement helps reduce or eliminate thermal degradation of the aerosol forming material and the presence of sidestream smoke.

While not a part of the fuel element, the aerosol generating means is preferably in a conductive heat exchange relationship with the fuel element, and preferably abuts or is adjacent to the fuel element. More preferably, the conductive heat exchange relationship is achieved by a heat conducting member, such as a metal tube or foil, which is preferably recessed or spaced from the lighting end of the fuel.

Preferably, the aerosol generating means includes one or more thermally stable materials which carry one or more aerosol forming materials. While not preferred, other aerosol generating means, such as heat rupturable microcapsules, or solid aerosol forming substances, are within the scope of the invention, provided they are capable of releasing sufficient aerosol forming vapors to satisfactorily resemble tobacco smoke.

Thermally stable materials which may be used as a substrate or carrier for the aerosol forming materials are well known to those skilled in the art. Useful substrates should be porous and must be capable of retaining an aerosol forming material when not in use and capable of releasing a potential aerosol forming vapor upon heating by the fuel element. Substrates, especially particulates, may be placed within a container, preferably formed from a conductive material.

The aerosol generating means may vary in length from about 2 mm to about 60 mm, preferably from about 5 mm to 40 mm, and most preferably from about 20 mm to 35 mm. The diameter of the aerosol generating means may vary from about 2 mm to about 8 mm, preferably from about 3 to 6 mm. If a non-particulate substrate is used, it may be provided with one or more holes, to increase the surface area of the substrate, and to increase air flow and heat transfer.

The aerosol forming material or materials used in the preferred smoking articles must be capable of forming an aerosol at the temperatures present in the aerosol generating means when heated by the burning fuel element. Substances having these characteristics include polyhydric alcohols, such as glycerin and propylene glycol, as well as aliphatic esters of mono-, di-, or polycarboxylic acids, such as methyl stearate, dimethyl dodecandioate, dimethyl tetradecandioate, and the like.

The preferred aerosol forming materials are polyhydric alcohols, or mixtures of polyhydric alcohols. Especially preferred aerosol formers are glycerin, propylene glycol, triethylene glycol, or mixtures thereof.

The aerosol generating means also may include one or more volatile flavoring agents, such as menthol, vanillin, artificial coffee, tobacco extracts, nicotine, caffeine, liquors, and other agents which impart flavor to the aerosol. It also may include any other desirable volatile solid or liquid materials.

In the illustrated embodiment of the cigarette, a roll of tobacco is employed downstream from the fuel element to add tobacco flavors to the aerosol. Hot vapors are swept through the tobacco to extract and distill the volatile components from the tobacco, without combustion or substantial pyrolysis. As illustrated, tobacco may be situated around the periphery of the metallic container, which increases heat transfer to the tobacco. The tobacco roll of tobacco acts as an insulating member and helps to simulate the feel and aroma of other cigarettes. Other preferred locations for tobacco include inside the capsule, e.g., as a partial or total substitute for the aerosol substrate and/or immediately behind the capsule.

The tobacco used may be any of the forms of tobacco available to the skilled artisan, including Burley, Flue Cured, Turkish, reconstituted tobacco, puffed tobacco extruded or densified tobaccos, and the like. Advantageously, a blend of tobaccos is used to contribute a variety of tobacco flavors to the aerosol. The tobacco charge may likewise contain tobacco additives, such as fillers, casings, reinforcing agents, humectants, flavor agents, flavor modifying agents, and the like.

By placing the tobacco charge in the present cigarette in a location remote from the high heat of the fuel element, the smoker receives an aerosol which contains the tastes and flavors of natural tobacco without the numerous combustion products produced by the burning of tobacco in other cigarettes.

As shown in the illustrated embodiment, the heat conducting member preferably contacts or overlaps only 1 to 2 mm of the rear portion of the fuel element and at least a portion of the aerosol generating means. Advantageously, the heat conducting member overlaps or otherwise contacts no more than about the rear 1.5 mm of the fuel element. Preferably, the overlap is within the range of about 1 to 1.5 mm, and most preferably, only about 0.5 mm.

This heat conducting member is preferably recessed or spaced behind the lighting end of the fuel element by at least about 1 mm or more, preferably by about 3 mm. Preferred recessed conducting members of this type do not interfere with the lighting or burning of the fuel element. These conducting members also help to extinguish the fuel when it burns back to the point of contact by the conductor, by acting as a heat sink, and do not protrude, even after the fuel has been consumed.

As illustrated, the heat conducting member preferably also forms a conductive container which encloses the aerosol forming materials. This combination with the fuel element constitutes the disposible cartridge of the present invention. Alternatively, a separate conductive container may be provided, especially in embodiments which employ particulate substrates or semi-liquid aerosol forming materials. In addition to acting as a container for the aerosol forming materials, the conductive container improves heat distribution to the aerosol forming materials and the preferred peripheral roll of tobacco and helps to prevent migration of the aerosol former to other components of the article. The container also provides a means for controlling the pressure drop through the article, by varying the number, size, and/or position of the passageways through which the aerosol former is delivered to the mouthend piece of the article. Moreover, in embodiments with a roll of tobacco around the periphery of the aerosol generating means, the container may be provided with peripheral passages or slots to control and direct the flow of vapors through the tobacco. The use of a container also simplifies the manufacture of the article by reducing the number of necessary elements and/or manufacturing steps.

The insulating members which may be employed in articles utilizing the fuel elements of this invention are preferably formed into a resilient jacket from one or more layers of an insulating material. Advantageously, this jacket is at least about 0.5 mm thick, preferably at least about 1 mm thick. Preferably, the jacket extends over more than half the length of the fuel element. The insulating jacket extends over substantially the entire outer periphery of the fuel element, and may extend over all or a portion of the aerosol generating means. Different materials may be used to insulate these two components of the article.

Preferred insulating members are resilient, to help simulate the feel of other cigarettes. Preferred fuel insulating materials should fuse during use and should have a softening temperature below about 650°–750° C. Preferred insulating materials also should not burn during use. However, slow burning carbons and like materials may be employed. These materials act primarily as an insulating jacket, retaining and directing a significant portion of the heat formed by the burning fuel element to the aerosol generating means. Because the insulating jacket becomes hot adjacent to the burning fuel element, to a limited extent, it also may conduct heat toward the aerosol generating means.

Currently preferred insulating materials for the fuel element include ceramic fibers, such as glass fibers. Two suitable glass fibers are available from the Manning Paper Company of Troy, N.Y., under the designations Manniglas 1000 and Manniglas 1200. Preferred glass fibers include C-glass and two experimental materials produced by Owens-Corning of Toledo, Ohio under the designations 6432 and 6437, which have a softening point of about 640° C., and fuse to some degree during use.

In most smoking articles employing the fuel elements of the present invention, the fuel/aerosol generating means combination is attached to a mouthend piece, such as that illustrated in FIG. 1, although a mouthend piece may be provided separately, e.g., in the form of a cigarette holder. This element of the article directs the vaporized aerosol forming materials into the mouth of the user. Due to its length, preferably about 35 to 50 mm or more, it also keeps the hot fire cone away from the mouth and fingers of the user and provides sufficient time for the hot aerosol to form and cool before it reaches the user.

Suitable mouthend pieces should be inert with respect to the aerosol forming substances, should offer minimum aerosol loss by condensation or filtration, and should be capable of withstanding the temperature at the interface with the other elements of the article. The preferred mouthend piece for the present cigarettes is the combination of rolled tobacco paper and nonwoven polypropylene scrim illustrated in FIG. 1. Other suitable mouthend pieces will be apparent to those of ordinary skill in the art.

The entire length of article or any portion thereof may be overwrapped with cigarette paper. Preferred papers at the fuel element end should not openly flame during burning of the fuel element. In addition, the paper should have controllable smolder properties and should produce a grey, cigarette ash.

In those embodiments utilizing an insulating jacket wherein the paper burns away from the jacketed fuel element, maximum heat transfer is achieved because air flow to the fuel source is not restricted. However, papers can be designed to remain wholly or partially intact upon exposure to heat from the burning fuel element. Such papers provide restricted air flow to the burning fuel element, thereby helping to control the temperature at which the fuel element burns and the subsequent heat transfer to the aerosol generating means.

To reduce the burning rate and temperature of the fuel element, thereby maintaining a low $CO/CO_2$ ratio, a non-porous or zero-porosity paper treated to be slightly porous, e.g., non-combustible mica paper with a plurality of holes therein, may be employed as the overwrap layer. Such a paper controls heat delivery, especially in the middle puffs (i.e., puffs 4 through 6).

To maximize aerosol delivery which otherwise would be diluted by radial (i.e., outside) air infiltration through the article, a non-porous paper may be used from the aerosol generating means to the mouth end.

Papers such as these are known in the cigarette and/or paper arts and mixtures of such papers may be employed for various functional effects. Preferred papers used in the articles of the present invention include RJR Archer's 8-0560-36 Tipping with Lip Release paper, Ecusta's 646 Plug Wrap and ECUSTA 30637-801-12001 manufactured by Ecusta of Pisgah Forest, NC, and Kimberly-Clark's papers P850-186-2, P1487-184-2 and P1487-125.

The present invention will be further illustrated with reference to the following examples which aid in the understanding thereof, but which are not to be construed as limitations thereof. All percentages reported herein, unless otherwise specified, are percent by weight. All temperatures are expressed in degrees Celsius. In all instances, the articles have a diameter of about 7 to 8 mm, the diameter of other cigarettes.

EXAMPLE 1

Smoking articles of the type substantially as illustrated in FIG. 1 were made with a compact extruded carbon fuel element in the following manner.

The carbon for the fuel element was prepared by carbonizing a non-talc containing grade of Grand Prairie Canadian Kraft hardwood paper under a nitrogen blanket, at a step-wise increasing temperature rate of about 10° C. per hour to a final carbonizing temperature of 750° C.

After cooling under nitrogen to less than about 35° C., the carbon was ground to a mesh size of minus 200. The powdered carbon was then heated to a temperature of about 850° C. to remove volatiles.

After cooling under nitrogen to less than about 35° C., the carbon was ground to a fine powder, i.e., a powder having an average particle size of from about 0.1 to 50 microns.

Figure 2:
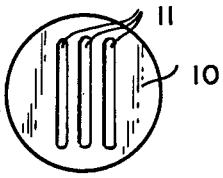
FIGS. 2–6 illustrate, from the lighting end, the preferred fuel element passageway configurations used in the present invention.

This fine powder was admixed with Hercules 7 HF sodium carboxymethylcellulose (SCMC) binder (9 parts carbon : 1 part binder), 1 wt. percent $K_2CO_3$, and sufficient water to make a stiff, dough-like paste. Long fuel element rods, having a predetermined diameter, and the peripheral passageway configuration substantially as depicted in FIG. 2, were then formed by ram extrusion through an appropriately shaped extrusion die. Individual fuel elements were cut to length from the extrudate rods and dried at room temperature.

The tubular capsule used to construct the illustrated smoking article was prepared from deep drawn aluminum, sealed at one end. The capsule had an average wall thickness of about 0.004 in. (0.01 mm), and was from about 25 to 30 mm in length, with a normal diameter of about 4.5 mm. The open end of the capsule was adjusted in diameter by flaring out to fit any given fuel element diameter (e.g., 5.0, 5.2, 5.3, 5.5, 6.0 mm, etc.), to an insertion depth of about 2 mm. The sealed end of the capsule was provided with two slot-like openings (each about $0.65 \times 3.45$ mm, spaced about 1.14 mm apart) to allow passage of the aerosol former to the user.

The substrate material for the aerosol generating means was a high surface area alumina (surface area $= 280\ m^2/g$), having a mesh size of from $-14$, $+20$ (U.S). Before use herein, this alumina was sintered for about 1 hour at a soak temperature from about 1400° to 1550° C. After cooling, this alumina was washed with water and dried.

This sintered alumina was combined with the ingredients shown in Table I, preferably in the indicated proportions:

TABLE I

| | |
|---|---|
| Alumina | 68.0% |
| Glycerin | 19.0% |
| Spray Dried Extract* | 7.0% |
| Flavoring Mixture** | 6.0% |
| Total: | 100.0% |

*Spray Dried Extract is the dry powder residue resulting from the evaporation of an aqueous tobacco extract solution. Preferred tobaccos are blended flue cured tobaccos.

**Flavoring Mixture is a mixture of flavor compounds which simulates the taste of cigarette smoke. One such material used herein was obtained from Firmenich of Geneva, Switzerland under the designation T69-22. This mixture may also contain mocdifiers of smoke pH, such as glucose pentaacetate and/or levulinic acid.

The capsule was filled with about 310 mg of this substrate material.

A fuel element was inserted into the open end of the filled capsule to a depth of about 2 mm. The fuel element - capsule combination was then overwrapped at the fuel element end with a 10 mm long, glass fiber jacket of Owens-Corning 6437 (having a softening point of about 650° C.), with 4 wt. percent pectin binder, to a diameter of about 7.5 mm. The glass fiber jacket was then overwrapped, first with Kimberly-Clark's P780-

63-5 paper, followed by Kimberly Clark's P850-208 paper.

A 28 mm×7.5 mm roll of puffed tobacco (75% Burley +25% Turkish) with an overwrap of Kimberly Clark's P1487-125 paper was modified to have a longitudinal passageway (about 4.5 mm diameter) therein. The jacketed fuel element-capsule combination was inserted into the passageway of the tobacco roll until the glass fiber jacket abutted the tobacco. The abutting sections were combined with Kimberly-Clark's P1768-65-2 paper forming the fuel-end segment of the article.

A mouthend piece of the type illustrated in FIG. 1, was constructed by combining two sections; (1) a 10 mm long×7.5 mm diameter rolled segment of Kimberly Clark's flavored tobacco paper (No. P144-185) overwrapped with Kimberly Clark's P850-186-2 plug wrap; and (2) a section of non-woven polypropylene scrim, rolled into a 30 mm long×7.5 mm diameter cylinder, overwrapped with Kimberly Clark's P850-184-2 plug wrap; with a combining overwrap of Kimberly Clark's P850-186-2 paper.

The combined mouthend piece was joined to the combined fuel-end segment by Ecusta's 30637-801-12001 tipping paper.

EXAMPLE 2

Fuel elements having the passageway configuration substantially as illustrated in FIG. 2 were prepared as described in Example 1.

Combined fuel-end segments were prepared as described in Example 1. The fuel element was 5.4 mm long with a diameter of 6.0 mm. Insert depth was 2 mm. The slots in the fuel element were 0.009×0.093 in., with 0.032 in. carbon between slots. The substrate weight in the loaded 30 mm long capsule was 270 mg.

These segments were tested for aerosol delivery by machine smoking under so-called human smoking conditions (50 ml puff volumes of two seconds duration, separated by 30 seconds of smolder). Aerosol delivery over 15 puffs was very good, averaging about 3 mg per puff. Total aerosol delivery was 45.9 mg.

These segments were also analyzed for carbon monoxide production by machine smoking under FTC smoking conditions using a Beckmann Instruments Co. Model 864 Non-dispersive IR Analyzer. Total carbon monoxide delivery for an average of 8 to 9 puffs was 12.8 mg.

EXAMPLE 3

Example 2 was repeated, but the fuel elements were "baked-out" i.e., heated in an inert atmosphere, for 3 hours at 900° C. Combined fuel-end segments prepared with these baked-out fuel elements had a total carbon monoxide delivery for 8 to 9 FTC puffs of only 8 to 9 mg.

EXAMPLE 4

Figure 3:
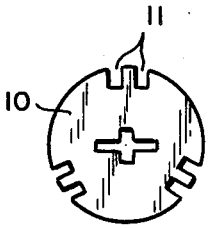
Figure 3A:
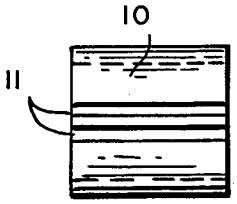

Fuel elements having the passageway configuration substantially as illustrated in FIG. 3 were prepared as described in Example 1.

Combined fuel-end segments were prepared as described in Example 1. The fuel element was 5.0 mm long with a diameter of 5.3 mm. Insert depth was 2 mm. The cross-shaped slot in the center of the fuel element was 0.075×0.020 in. and 0.040×0.020 in., and the 3 sets of peripheral channels were 0.030×0.016 in. with 0.021 in. of carbon between the channels. The substrate weight in the loaded 25 mm long capsule was 270 mg.

These segments were tested for aerosol delivery by machine smoking under so-called human smoking conditions (50 ml puff volumes of two seconds duration, separated by 30 seconds of smolder). Aerosol delivery over 15 puffs was very good, averaging about 2.4 mg per puff. Total aerosol delivery was 36.1 mg.

These segments were also analyzed for carbon monoxide production by machine smoking under FTC smoking conditions using a Beckmann Instruments Co. Model 864 Non-dispersive IR Analyzer. Total carbon monoxide delivery over an average of 8 to 9 puffs was 6.2 mg.

EXAMPLE 5

Figure 4:
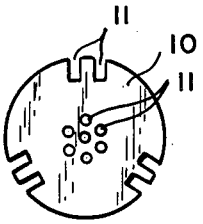

Fuel elements having the passageway configuration substantially as illustrated in FIG. 4 were prepared as described in Example 1.

Combined fuel-end segments were prepared as described in Example 1. The fuel element was 5.0 mm long with a diameter of 5.3 mm. Insert depth was 2 mm. Each of the seven holes at the center of the fuel element had a diameter of 0.020 in., while the spacing between the holes was 0.016 in. The 3 sets of peripheral channels were 0.030×0.016 in. with 0.021 in. of carbon between the channels. The 25 mm long capsule was loaded with 270 mg of the standard alumina substrate.

These segments were tested for aerosol delivery by machine smoking under so-called human smoking conditions (50 ml puff volumes of two seconds duration, separated by 30 seconds of smolder). Aerosol delivery over 15 puffs was very good, averaging about 2.4 mg per puff. Total aerosol delivery was 36.3 mg.

These segments were also analyzed for carbon monoxide production by machine smoking under FTC smoking conditions using a Beckmann Instruments Co. Model 864 Non-dispersive IR Analyzer. Total carbon monoxide delivery over an average of 8 to 9 puffs was 8.2 mg.

EXAMPLE 6

Figure 5:
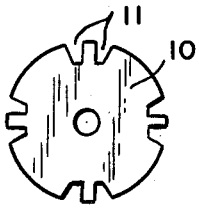

Fuel elements having the passageway configuration substantially as illustrated in FIG. 5 were prepared as described in Example 1.

Combined fuel-end segments were prepared as described in Example 1. The fuel element was 5.0 mm long with a diameter of 5.3 mm. Insert a depth was 2 mm. The hole at the center of the fuel element had a diameter of 0.035 in., and the 4 sets of peripheral channels were 0.030×0.016 in. with 0.021 in. of carbon between the channels. The 30 mm long capsule was loaded with 270 mg of the standard alumina substrate.

These segments were tested for aerosol delivery by machine smoking under so-called human smoking conditions (50 ml puff volumes of two seconds duration, separated by 30 seconds of smolder). Aerosol delivery over 15 puffs was very good, averaging about 2.5 mg per puff. Total aerosol delivery was 37.5 mg.

These segments were also analyzed for carbon monoxide production by machine smoking under so-called FTC smoking conditions using a Beckmann Instruments Co. Model 864 Non-dispersive IR Analyzer. Total carbon monoxide delivery over an average of 8 to 9 puffs was 8.1 mg.

EXAMPLE 7

Figure 6:
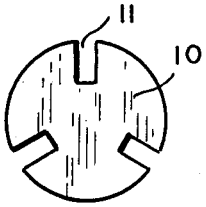

Fuel elements having the passageway configuration substantially as illustrated in FIG. 6 were prepared as described in Example 1.

Combined fuel-end segments were prepared as described in Example 1. The fuel element was 6.0 mm long with a diameter of 5.3 mm. Insert depth was 2 mm. Each of the three peripheral slots was 2 mm deep by 0.008 in. A 20 mm long capsule was loaded with 270 mg of the standard alumina substrate.

These segments were tested for aerosol delivery by machine smoking under so-called human smoking conditions (50 ml puff volumes of two seconds duration, separated by 30 seconds of smolder). Aerosol delivery over 15 puffs was very good, averaging about 2.9 mg per puff. Total aerosol delivery was 43.5 mg.

These segments were also analyzed for carbon monoxide production by machine smoking under so-called FTC smoking conditions using a Beckmann Instruments Co. Model 864 Non-dispersive IR Analyzer. Total carbon monoxide delivery over an average of 8 to 9 puffs was 9.5 mg.

EXAMPLE 8

Example 7 was repeated, but the fuel elements were "baked-out" i.e., heated in an inert atmosphere, for 3 hours at 900° C. Combined fuel-end segments prepared with these baked-out fuel elements had a total carbon monoxide delivery for 8 to 9 FTC puffs of only 4 to 5 mg.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A smoking article comprising:

(a) a carbonaceous fuel element having a plurality of passageways therein, said fuel element having a diameter of less than about 7 mm and a length of less than about 7 mm; and (b) a physically separate aerosol generating means including an aerosol forming material;

said smoking article providing no more than about 10 mg of carbon monoxide over 8 puffs under smoking conditions consisting of 35 ml puff volumes of two seconds duration separated by 58 seconds of smolder.

2. The smoking article of claim 1, wherein the fuel element has a diameter of from about 4.0 mm to 6.5 mm and a length of from about 3 mm to 6.5 mm.

3. The smoking article of claim 1, wherein the fuel element has a diameter of from about 4.8 mm to 6.0 mm and a length of from about 5.5 mm to 6.0 mm.

4. The smoking article of claim 1, 2, or 3, wherein the passageways in said fuel element are centrally situated longitudinal passageways.

5. The smoking article of claim 1, 2, or 3, wherein the passageways in said fuel element include one or more peripheral passageways.

6. The smoking article of claim 1, 2, or 3, wherein said fuel element comprises at least about 80 percent carbon by weight.

7. The smoking article of claim 1, 2, or 3, wherein said fuel element is baked-out after formation at from about 800°–950° C.

8. The smoking article of claim 6, wherein the carbon monoxide provided over eight puffs is no more than about 8 mg.

9. The smoking article of claim 6, wherein the carbon monoxide provided over eight puffs is no more than about 6 mg.

10. A smoking article comprising:

(a) a carbonaceous fuel element having a plurality of peripheral passageways, said fuel element having a diameter of from about 4.0 mm to about 6.5 mm and a length of from about 3 mm to about 6.5 mm; and (b) a physically separate aerosol generating means including an aerosol forming material;

said smoking article providing no more than about 10 mg of carbon monoxide over 8 puffs under smoking conditions consisting of 35 ml puff volume of two seconds duration separated by 58 seconds of smolder.

11. The smoking article of claim 10, wherein the fuel element has a diameter of from about 4.8 mm to 6.0 mm and a length of from about 5.5 mm to 6.0 mm.

12. The smoking article of claim 11, which further includes at least one centrally located longitudinal passageway at least partially therethrough.

13. The smoking article of claim 10, 11, or 12, wherein said fuel element comprises at least about 90 percent carbon by weight.

14. The smoking article of claim 11, 12, or 13, wherein said fuel element is baked-out after formation at from about 800°–950° C.

15. The smoking article of claim 14, wherein the carbon monoxide provided over eight puffs is no more than about 8 mg.

16. The smoking article of claim 15, wherein the carbon monoxide provided over eight puffs is no more than about 6 mg.

17. A disposable cartridge for use in smoking articles comprising:

(a) a carbonaceous fuel element having a plurality of peripheral passageways, said fuel element having a diameter of from about 4.0 mm to about 6.6 mm and a length of from about 3 mm to about 6.5 mm; and (b) a capsule member, said member retaining an aerosol generating means and overlapping about 1–2 mm of said fuel element, and having at least one passageway for the release of aerosol therefrom; said smoking article providing no more than about10 mg of carbon monoxide over 8 puffs under smoking conditions consisting of 35 ml puff volume of two seconds durations separated by 58 seconds of smolder.

* * * * *

UNITED STATES PATENT AND TRADEMARK OFFICE

CERTIFICATE OF CORRECTION

PATENT NO. : 4,881,556

DATED : 11/21/89

INVENTOR(S) : Jack F. Clearman, et al.

It is certified that error appears in the above—identified patent and that said Letters Patent is hereby corrected as shown below:

At number [56] on the cover sheet, under U.S. Patent Documents, add the following reference.

U.S. Pat. No. 3,943,941 3/76 Boyd

At Column 9, line 4, "+" should be --&--.

At Column 10, line 46, delete "a" after Insert.

Signed and Sealed this

Twenty-second Day of January, 1991

*Attest:*

HARRY F. MANBECK, JR.

*Attesting Officer*

*Commissioner of Patents and Trademarks*